US006003353A

United States Patent [19]

Ootani et al.

[11] Patent Number: 6,003,353

[45] Date of Patent: Dec. 21, 1999

[54] BENDING METHOD AND BENDING APPARATUS

[75] Inventors: Toshiro Ootani; Kazuhiro Oda, both of Hirakata; Toshiyuki Ooenoki, Osaka, all of Japan

[73] Assignee: Komatsu, Ltd., Tokyo, Japan

[21] Appl. No.: 09/131,878

[22] Filed: Aug. 10, 1998

[30] Foreign Application Priority Data

| | | | |
|---|---|---|---|
| Aug. 22, 1997 | [JP] | Japan | 9-226417 |
| Aug. 22, 1997 | [JP] | Japan | 9-226499 |
| Sep. 12, 1997 | [JP] | Japan | 9-248412 |

[51] Int. Cl.[6] ..... B21C 51/00

[52] U.S. Cl. ..... 72/31.1; 72/15.3; 72/17.3; 72/37; 72/702

[58] Field of Search ..... 72/14.8, 15.3, 72/16.2, 16.3, 17.3, 19.6, 19.7, 20.1, 20.2, 31.1, 31.11, 37, 389.3, 389.5, 702

[56] References Cited

U.S. PATENT DOCUMENTS

| | | | |
|---|---|---|---|
| 4,819,467 | 4/1989 | Graf et al. | 72/20.1 |
| 5,535,611 | 7/1996 | Lilie | 72/15.3 |
| 5,704,238 | 1/1998 | Tokai | 72/16.2 |
| 5,813,263 | 9/1998 | Tokai | 72/21.3 |
| 5,839,310 | 11/1998 | Tokai et al. | 72/31.11 |

FOREIGN PATENT DOCUMENTS

| | | |
|---|---|---|
| 1-228612 | 9/1989 | Japan . |
| 6-328136 | 11/1994 | Japan . |
| 7-265957 | 10/1995 | Japan . |
| 7-314042 | 12/1995 | Japan . |
| 9-201623 | 8/1997 | Japan . |

*Primary Examiner*—Joseph J. Hail, III
*Assistant Examiner*—Ed Tolan
*Attorney, Agent, or Firm*—Nikaido Marmelstein Murray & Oram LLP

[57] ABSTRACT

For the purpose of making it possible to estimate the spring back angle and/or final driving position of the driving die with good accuracy even if there are some variations from lot to lot in the material characteristics values, and thereby achieve bending with extremely high angle accuracy, the actual bending angle is directed at no less than two provisional driving positions of the driving die during the bending of a workpiece. Based on the relationship of the amount of change in the driving amount to the amount of change in the actual bending angle relating to those provisional driving positions, a determination is made of the relationship of the spring back angle to the target bending angle of the workpiece for the respective working conditions of the bending concerned which are stored in advance. From this relationship, a determination is made for the final driving position of the driving die, and the driving die is driven to that determined final driving position.

5 Claims, 8 Drawing Sheets

BENDING METHOD AND BENDING APPARATUS

TECHNICAL FIELD

The present invention relates to a bending method and a bending apparatus for bending sheet-like workpiece by pressing it with a driving die and a fixed die.

BACKGROUND ART

It is generally known that, when bending in V shape a sheet-like workpiece by using a bending machine such as press brake, etc., the behaviour relating the plastic deformation of the workpiece changes according to the characteristic values of the material and, for that reason, the bending angle greatly varies from lot to lot even with one same material depending on the variations of characteristic values of that material. From this fact, it is extremely difficult to control the driving amount of the driving die and, in actual bending, it was normally the case that this control is made by a sixth sense of a skilled operator.

To cope with such problems, a variety of press brakes are proposed which are designed to detect the bending angle of the workpiece during the bending, and control the final driving amount of the driving die based on that detected bending angle, and put to practical use.

For example, the type proposed in Japanese Patent Laid-Open Publication No. 6-328136 (1994) is realized in such a way as to once unload by moving and separating the upper and lower dies half way during the bending process, determine the spring back angle of the workpiece by measuring the bending angle of the workpiece before and after this unloading, and then calculate the final driving amount from the spring back angle determined this way and the bending angle of the workpiece before moving and separation of the die. Moreover, the type proposed in Japanese Patent Laid-Open Publication No. 7-265957 (1995), for example, is realized in a way to measure the bending angle of the workpiece in the state in which the die pressurizes the workpiece during the bending, and calculate the final driving amount of the driving die based on the result of this measurement. In that case, it is so arranged that the data of spring back angle is stored in advance in layers prepared for respective kinds of material and thicknesses of workpiece, and the relation of driving amount to the bending angle of the workpiece is corrected by using this stored data.

However, a problem with the method disclosed in said former publication (Japanese Patent Laid-Open Publication No. 6-328136 (1994)) is that, because the upper and lower dies are once relatively moved for separation on the way of the bending process, the workpiece may possibly fall down at the time of unloading causing displacement of the contact point between the die and the workpiece, in the case of a workpiece of asymmetric shape, and it becomes necessary to prevent falling of the workpiece by some means or another.

On the other hand, the method disclosed in said latter publication (Japanese Patent Laid-Open Publication No. 7-265957 (1995)) can solve said problem of falling of workpiece, because the bending angle of the workpiece is measured in pressurized state. However, since the spring back angle θs has some slight variations due to variations material characteristic values, as shown in FIG. 12, it becomes necessary to either estimate or detect this spring back angle with good accuracy, to achieve bending of higher accuracy. This FIG. 12, showing the spring back angle at various bending angles in cold rolled steel sheet of different lots of same kind for 6 different kinds, indicates that the spring back angle deviates by approximately ±0.3° because of variations from lot to lot in the material characteristic.

Moreover, with the method described on this latter publication, there are cases where the accuracy of estimation of final driving amount becomes poor, because it simply corrects the relation of the driving amount to the bending angle of the workpiece stored in advance. Namely, as shown in FIG. 13, the relation of the driving amount of the driving die to the bending angle is a substitute characteristic of mechanical properties of the workpiece material submitted to bending, and the bending accuracy is largely influenced by a change of this workpiece material. Therefore, although the bending can be made with good accuracy even with this method in the case of bending of a material having characteristics close to the mechanical properties of the material stored in advance, there is a risk of poor bending angle accuracy due to a large difference between the driving amount and the bending angle in the case of materials with much different mechanical properties.

SUMMARY OF THE INVENTION

The object of the present invention, realized to solve such problems, is to provide a bending method and a bending apparatus capable of estimating the spring back angle and/or final driving position with good accuracy even if there are some variations from lot to lot in the material characteristics values of material, and thereby achieving bending with extremely high angle accuracy.

To achieve the object described above, the bending method according to the first invention is a bending method for bending sheet-like workpiece by pressing it with a driving die and a fixed die, comprising the steps of detecting the actual bending angle of the workpiece at no less than two provisional driving positions of the driving die during the bending of the workpiece, determining, based on the relationship of the amount of change in the driving amount to the amount of change in the actual bending angle relating to those provisional driving positions, the relationship of the spring back angle to the target bending angle of the workpiece for the respective working conditions of the bending concerned stored in advance, determining, from this relation, the final driving position of the driving die, and driving the driving die to that determined final driving position.

In the present invention, in the bending of a workpiece, the driving die is driven to the first provisional driving position and the actual bending angle of the workpiece is detected at that position, and then the driving die is further driven to the next provisional driving position and the actual bending angle of the workpiece is detected again at that position. Since the actual bending angle of the workpiece is detected at no less than two provisional driving positions this way, the relationship of the spring back angle to the target bending angle of the workpiece corresponding to the respective working conditions of the bending concerned stored in advance is determined based on the relationship of the amount of change in the driving amount to the amount of change in the actual bending angle corresponding to those provisional driving positions and, from this relationship, the final driving position of the driving die is determined. According to the present invention, in the case where variations from lot to lot in characteristic values of one same material are taken into account, the relationship of the amount of change in the respective driving amounts to the amount of change in the respective actual bending angles at no less than two provisional driving positions is used, as substitute characteristic of "n" value (workpiece hardening coefficient) which is a characteristic value having the greatest influences on the spring back angle. By using such relationship, it becomes possible to estimate the spring back angle with good accuracy even if there are some variations in the material characteristics values among material lots, and determine the final driving position based on the estimated value of this high-accuracy spring back angle, thus achieving bending with extremely high accuracy.

Next, the bending method according to the second invention is a bending method for bending sheet-like workpiece by pressing it with a driving die and a fixed die, comprising the steps of detecting the actual bending angle of the workpiece at no less than two provisional driving positions of the driving die during the bending of the workpiece, determining, based on the relationship of the amount of change in the driving amount to the amount of change in the actual bending angle relating to those provisional driving positions, the relationship of the spring back angle to the target bending angle of the workpiece for the respective working conditions of the bending concerned stored in advance, determining, by correcting this relationship based on the relationship of the spring back angle to the ratio of the amount of change in the driving amount to the amount of change in the actual bending angle, final driving position of driving die, and driving the driving die to that determined final driving position.

In the present invention, in the bending of a workpiece, the driving die is driven to the first provisional driving position and the actual bending angle of the workpiece is detected at that position, and then the driving die is further driven to the next provisional driving position and the actual bending angle of the workpiece is detected again at that position. As the actual bending angle of the workpiece is detected at no less than two provisional driving positions this way, the relationship of the spring back angle to the target bending angle of the workpiece for the respective working conditions of the bending concerned stored in advance is determined based on the relationship of the amount of change in the driving amount to the amount of change in the actual bending angle corresponding to those provisional driving positions and, as this relationship is corrected based on the relationship of the spring back angle to the ratio of the amount of change in the driving amount to the amount of change in the actual bending angle, the final driving position of the driving die is determined. According to the present invention, in the case where variations from lot to lot in characteristic values of one same material are taken into account, the relationship of the amount of change in the respective driving amounts to the amount of change in the actual bending angle at no less than two provisional driving positions is used, as substitute characteristic of "n" value (workpiece hardening coefficient) which is a characteristic value having the greatest influences on the spring back angle, and the spring back angle is determined based on this relationship. Moreover, similarly, based on the relationship of the amount of change in the respective driving amounts to the amount of change in the respective actual bending angles at those no less than two provisional driving positions or, in other words, by considering the relationship of the driving amount to the spring back angle which is a substitute characteristic of mechanical properties of the material, the final driving position providing the target bending angle is determined by either curvilinear approximation or linear approximation. Therefore, it becomes possible to estimate the spring back angle and the final driving position with good accuracy even if there are some variations in the material characteristics values among material lots, for example.

Next, the bending apparatus according to the third invention, which relates to an apparatus for concretely realizing the bending method according to the first invention, is a bending apparatus for bending sheet-like workpiece by pressing it with a driving die and a fixed die, characterized in that it comprises:

(a) storing means for storing the relationship of the driving amount of the driving die to the bending angle of the workpiece for the respective working conditions, and the relationship of the spring back angle to the ratio of the amount of change in the driving amount to the amount of change in the actual bending angle, (b) bending angle detecting means for detecting the bending angle during the bending of the workpiece, (c) calculating means for calculating the amount of change in the actual bending angle of the workpiece detected by the bending angle detecting means at no less than two provisional driving positions of the driving angle and the amount of change in the driving amount relating to those respective driving positions, calculating, from the relationship of the spring back angle to the ratio of amount of change in the driving amount to the amount of change in the actual bending angle stored in the storing means, the spring back angle at the target bending angle of the workpiece, and calculating the final driving position of the driving die based on the spring back angle obtained by this calculation, and (d) die driving means for driving the driving die to the final driving position after driving it to the provisional driving positions.

In the present invention, the relationship of the spring back angle to the ratio of the amount of change in the driving amount to the amount of change in the actual bending angle is stored in advance in the storing means. In the bending of workpiece, the driving die is driven to the first provisional driving position by the die driving means and the actual bending angle of the workpiece is detected at that position by the bending angle detecting means, and then the driving die is further driven to the next provisional driving position and the actual bending angle of the workpiece is detected again at that position. As the actual bending angle of the workpiece is detected at no less than two provisional driving positions this way, the spring back angle at the target bending angle of the workpiece is calculated, from the relationship of the spring back angle to the ratio of the amount of change in the driving amount to the amount of change in the actual bending angle stored in the storing means, and the final driving position of the driving die is calculated by taking account of this spring back angle. The driving die is driven to this calculated final driving position to terminate the bending process. In this way, the spring back angle at the target bending angle of the workpiece is estimated based on the actual bending angle at no less than two angle detecting positions, and it becomes possible to estimate this spring back angle with good accuracy even if there are some variations from lot to lot in the material characteristics values of material, thereby achieving bending with extremely high accuracy.

In this third invention, it is desirable for the calculating means to be designed in a way to calculate the final driving position of the driving die by correcting the relationship of the spring back angle to the target bending angle of the workpiece, based on the relationship of the spring back angle to the ratio of the amount of change in the driving amount to the amount of change in the actual bending angle.

The no less than two provisional driving positions can be calculated from the relationship of the driving amount of the driving die to the bending angle of the workpiece and the relationship of the spring back angle to the bending angle of the workpiece stored in the storing means.

BEST MODE FOR CARRYING OUT THE INVENTION

Next, explanation will be made hereafter on concrete modes of execution of the bending method and bending apparatus according to the present invention, with reference to the drawings.

Embodiment 1

Figure 1:
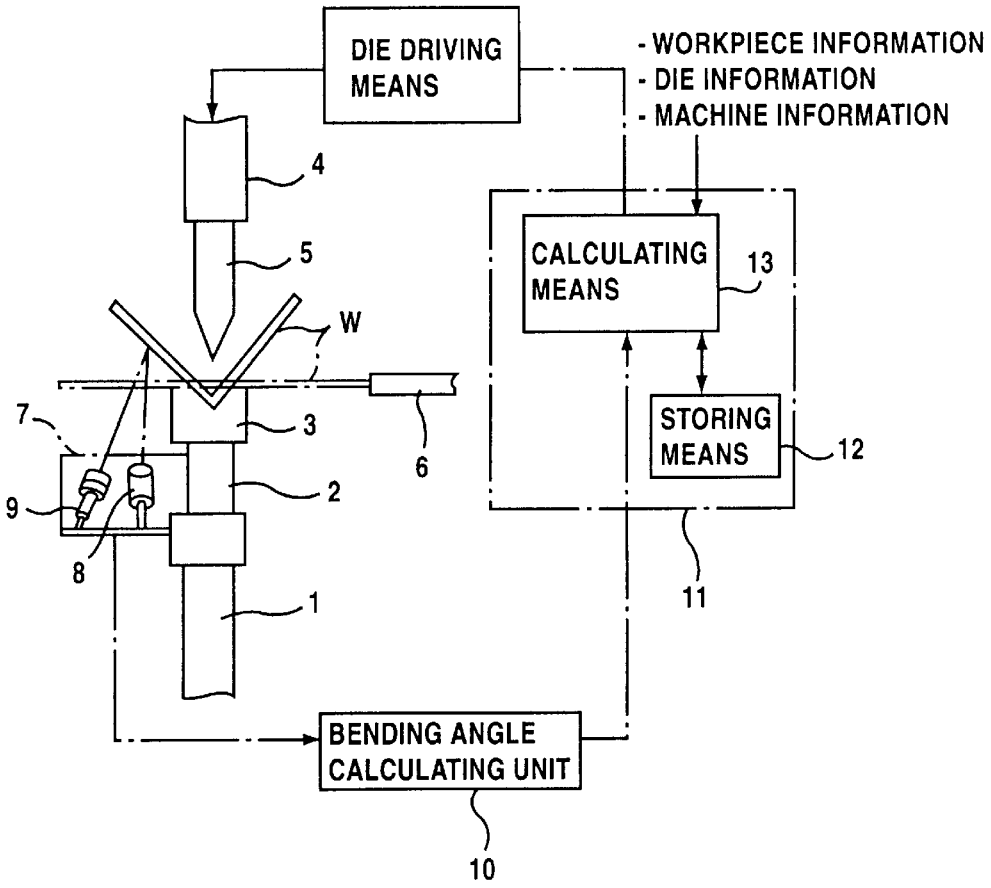
FIG. 1 is a system construction drawing of the bending apparatus according to the first embodiment of the present invention.

FIG. 1 indicates a system construction drawing of the bending apparatus according to the first embodiment of the present invention.

In the bending apparatus (press brake) of this embodiment, a die base 2 is fastened onto a fixed table 1, and a lower die 3 is mounted on this die base 2, while an upper die 5 is attached to the bottom part of a ram 4 facing this lower die 3 and driven vertically in a way to come close to and get away from this lower die 3. A sheet-like workpiece W to be bent is inserted between the lower die 3 and the upper die 5, and the bending of the workpiece W is performed by lowering the ram 4 in the state in which the end part of this workpiece W is pushed against a back stop device 6 and by pressing that workpiece W with the lower die 3 and the upper die 5.

At the front part of the fixed table 1 is provided an angle detecting unit 7 for detecting the bending angle of the workpiece W during the bending process of that workpiece W. This angle detecting unit 7 comprises a light source 8 for projecting a slit light on the bent external surface of the workpiece W and a CCD camera 9 for photographing the linear projected image formed on the external surface of the workpiece W, so as to detect the bending angle of the workpiece W by processing the image output by this CCD camera 9. This angle detecting unit 7 can be provided not only in front of the fixed table 1 but also behind it, thus making it possible to improve the angle detecting accuracy by detecting the bending angle on two bent external surfaces of the workpiece from both sides of the fixed table 1.

The image output by the CCD camera 9 is not only shown on a nonillustrated monitor TV but also is processed in the bending angle calculating unit 10 as image data. The bending angle of the workpiece W is calculated with this operation in the bending angle calculating unit 10, and the result of that calculation is input in a NC system 11. This NC system 11 is provided with a storing means 12 for storing the relationship of a plurality of spring back angles to the ratio of the amount of change in the driving amount to the amount of change in the actual bending angle for the respective bending conditions (working conditions) of the workpiece W, and is also provided with an calculating means 13 for calculating the provisional driving positions and the final driving position (bottom dead center) of the upper die 5 based on the data stored in this storing means 12 and the bending conditions (material, thickness, bending shape, machine information, etc.) of the workpiece W.

Figure 2:
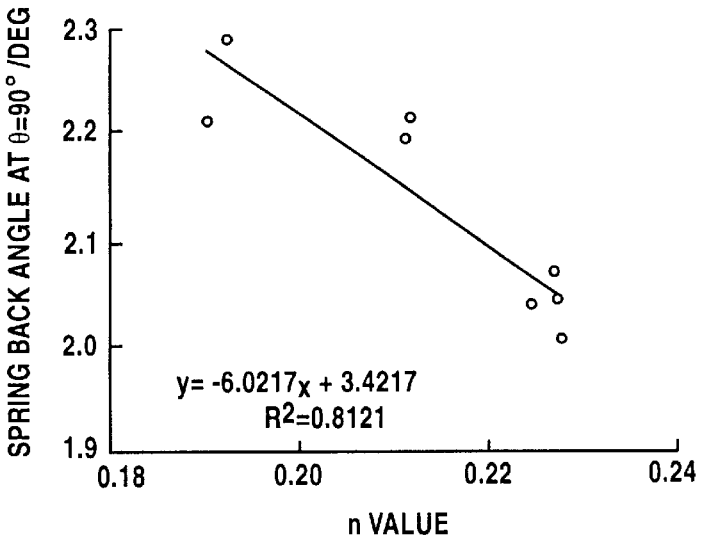
FIG. 2 is a graph showing the correlation between the "n" value and the spring back angle.
Figure 3:
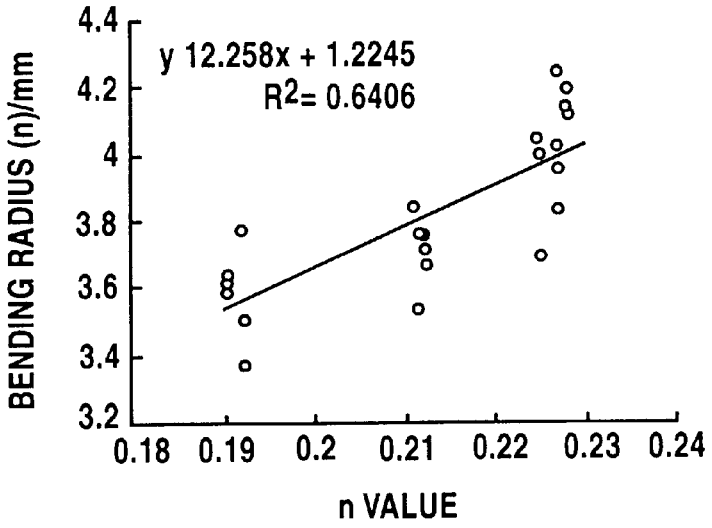
FIG. 3 is a graph showing the correlation between the "n" value and the bending radius of the material.
Figure 4:
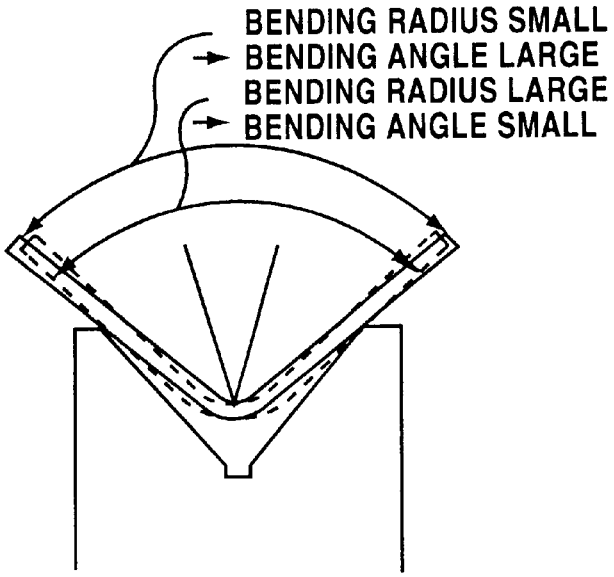
FIG. 4 is a drawing explaining the relationship of the bending radium to the bending angle at one same bottom dead center.

The spring back (return by elasticity) angle produced at the time of working of a sheet-like workpiece W is said to be correlated to the tensile strength longitudinal modulus of elasticity, work hardening coefficient ("n" value), etc. of the material and, considering only the variations from lot to lot of characteristic values of one same material, the characteristic value having the greatest influences on this spring back angle is believed to be the "n" value. FIG. 2 indicates the result of checking of the correlation between the "n" value and the spring back angle in a cold rolled steel sheet. On the other hand, it is known that, as shown in FIG. 3, there is a high correlation between the "n" value and the bending radius of the material and it is also known that, as shown in FIG. 4, a change is produced in the bending angle of the workpiece W at one same bottom dead center (driving position of the upper die) if the bending radius of the workpiece W is different. Namely, at a certain bottom dead center, a relationship is established that a material with smaller bending angle of workpiece has a larger bending radius and a larger "n" value, to eventually have a larger spring back angle. From this fact, it becomes possible to estimate the spring back angle by detecting the bending angle of the workpiece at a prescribed position and, by controlling the driving amount of the upper die 5, which is the driving die, based on this result, it becomes possible to achieve bending of high dimensional accuracy regardless of variations in the material.

This embodiment is designed in such a way as to calculate the ratio dD/dθ of the amount of change dD in the respective driving amounts to the amount of change dθ in the respective bending angles at no less than two provisional driving positions and, based on the relationship of the spring back angle θs to this ratio dD/dθ, calculate the spring back angle at the target bending angle.

Figure 5:
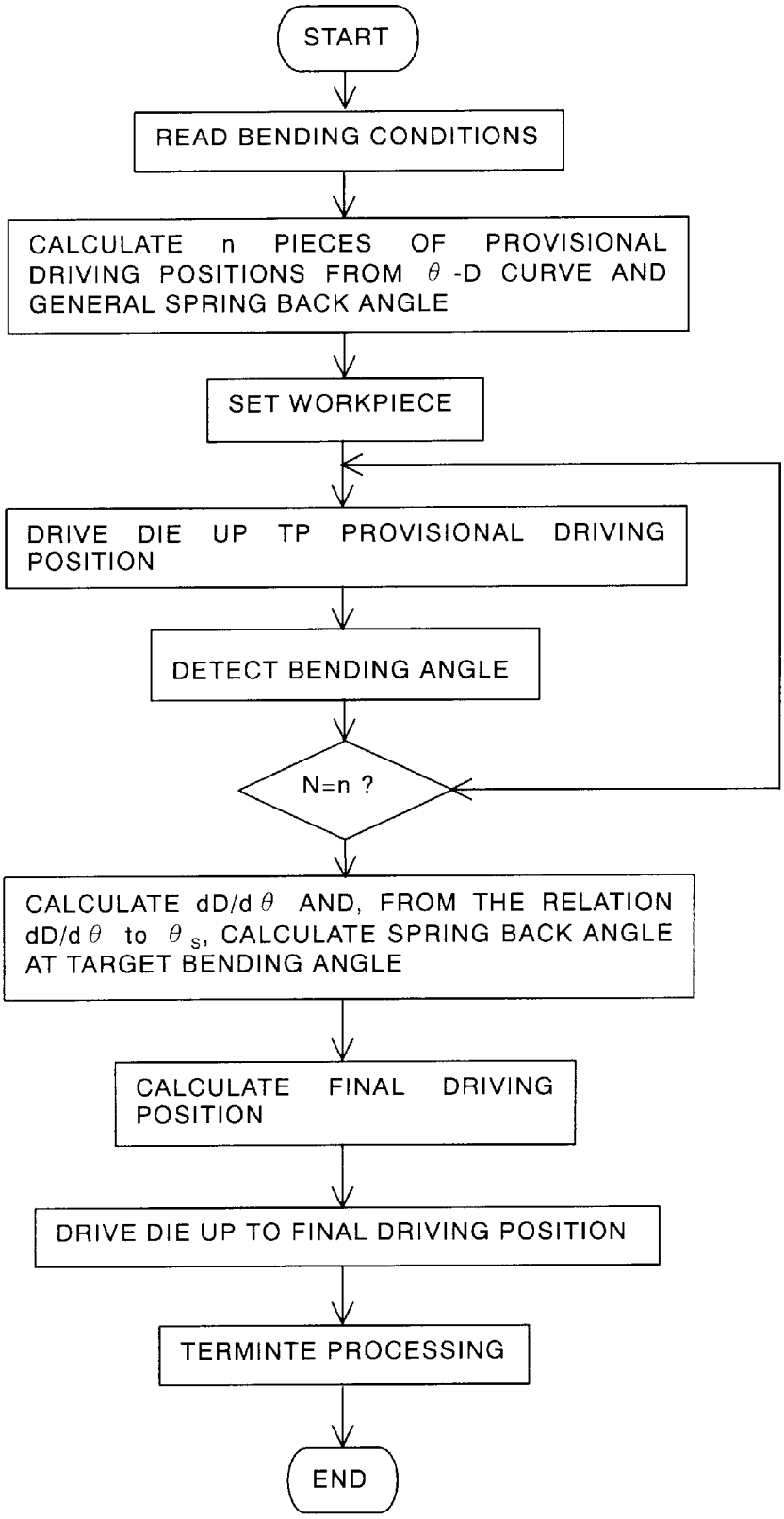
FIG. 5 is a flow chart showing the control flow of the die driving amount in the first embodiment.

Next, the control flow of the die driving amount in this embodiment will be explained according to the flow chart indicated in FIG. 5.

S1: Reads the bending conditions (material, thickness, bending shape, die information, machine information, etc.) of the workpiece W input and stored in the storing means 12 in advance.

Figure 6:
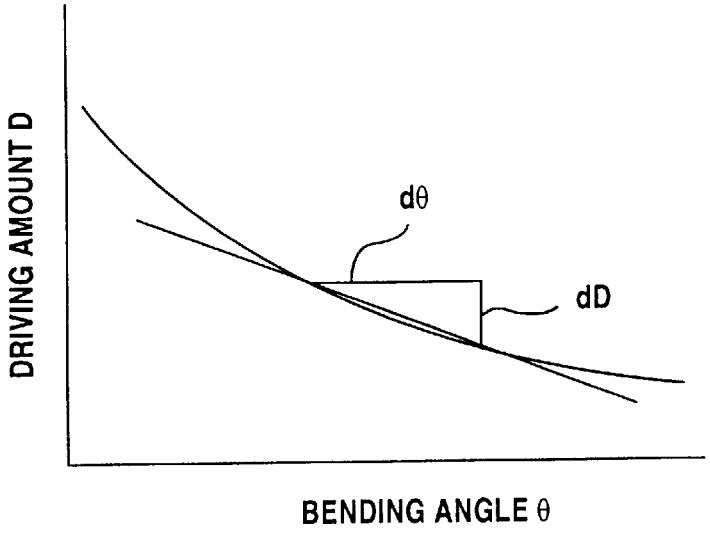
FIG. 6 is a graph showing the relationship of the driving amount to the bending angle.

S2: Selects the relational expression of the default (initial value owned by the NC system) from the relationship of the die driving amount D to the bending angle θ (see FIG. 6) of the workpiece W and the relationship of the spring back angle to the target bending angle of the workpiece, and calculates the provisional driving position at the time when the upper and lower dies are made to move closer to each other or, in other words, the angle detecting position at "n" points (n≧2). It is desired that those provisional driving positions be found in the range while not bending the workpiece W too much and that at least one point be at a position as close to the target angle as possible.

S3~S5: Starts bending as the workpiece W is set by the operator, and makes the upper die 5 move closer to the lower die 3 up to the first provisional driving position of the "n" points of provisional driving position. When (the upper die 5) reached this provisional driving position, detects the bending angle of the workpiece W with the angle detecting unit 7.

S6: Makes the upper die 5 move again to the second provisional driving position in the case where the number of times of angle detection N has not yet reached "n" (N<n), and detects the bending angle of the workpiece W again at this second provisional driving position. This processing is performed repeatedly until N=n is reached.

Figure 7:
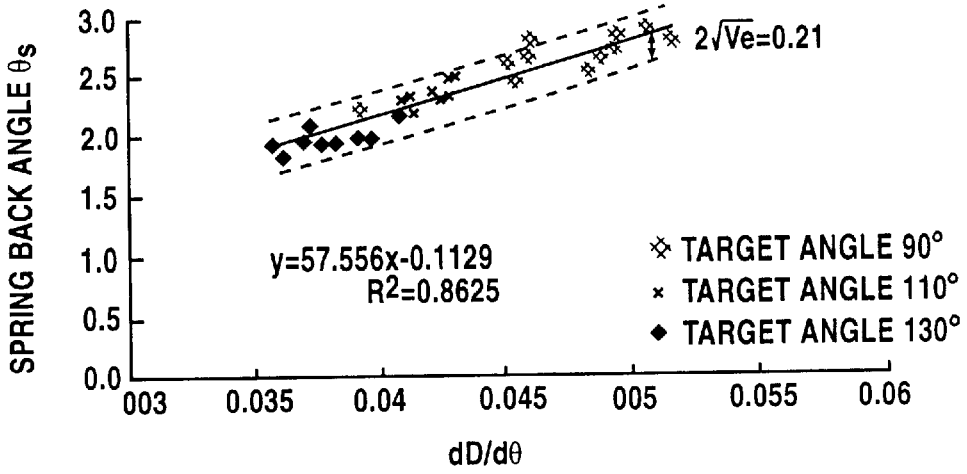
FIG. 7 is a graph showing the relationship of the spring back angle to the dD/dθ.

S7: Calculates the ratio dD/dθ of the amount of change dD in the driving amount and the amount of change dθ in the bending angle, from the results of detection of angle at "n" points. In the case of n=2 for example, calculates the ratio dD/dθ of the difference dD in the driving amount and the difference dθ in the bending angle at two angle detecting positions. By using the relationship of the spring back angle θs to the ratio dD/dθ stored in advance or, in other words, the dD/dθ-θs curve (see FIG. 7), determines the spring back angle θs corresponding to dD/dθ-θs calculated as above. In this way, estimates the spring back angle θs at the target bending angle. Here, in the case where there are two (n=2) angle detecting positions (provisional driving positions) in the calculation of the ratio dD/dθ, the ratio dD/dθ can be determined by determining a straight line passing through those two points based on two detected values, on a graph showing the relationship of the die driving amount D to the bending angle θ. Moreover, in the case where there are no less than three (n≧3) angle detecting positions (provisional driving positions), the ratio dD/dθ can be determined by using the method of least squares, etc. based on no less than three detected values. FIG. 7 indicates the relationship of the spring back angle θs to the ratio dD/dθ.

S8~S9: Calculates the final driving position of the upper die 5 based on the estimated spring back angle θs, and drives the upper die 5 again up to this position.

S10: Terminates the working to end the flow.

The processing indicated in this flow may be performed for each time of bending process, but corrective operation may also be instructed by the operator in any desired process at the time of change in material lot, etc.

According to this embodiment, the spring back angle at the target bending angle of the workpiece can be estimated based on the actual bending angle at no less than two angle detecting positions during the bending process of the workpiece, and this makes it possible to estimate the spring back angle with high accuracy even when there are some variations in the spring back angle due to variations from lot to lot in the material characteristic values, thus enabling improvement of bending accuracy.

Embodiment 2

This embodiment is realized in a way to estimate the final driving position of the driving die, based on the relationship of the amount of change in the driving amount to the amount of change in the actual bending angle at no less than two provisional driving positions of the driving die. The system construction in this embodiment is the same as that of the first embodiment indicated in FIG. 1. Therefore, explanation on portions common to the first embodiment will be omitted, and only the portions unique to this embodiment will be explained hereafter.

Figure 8:
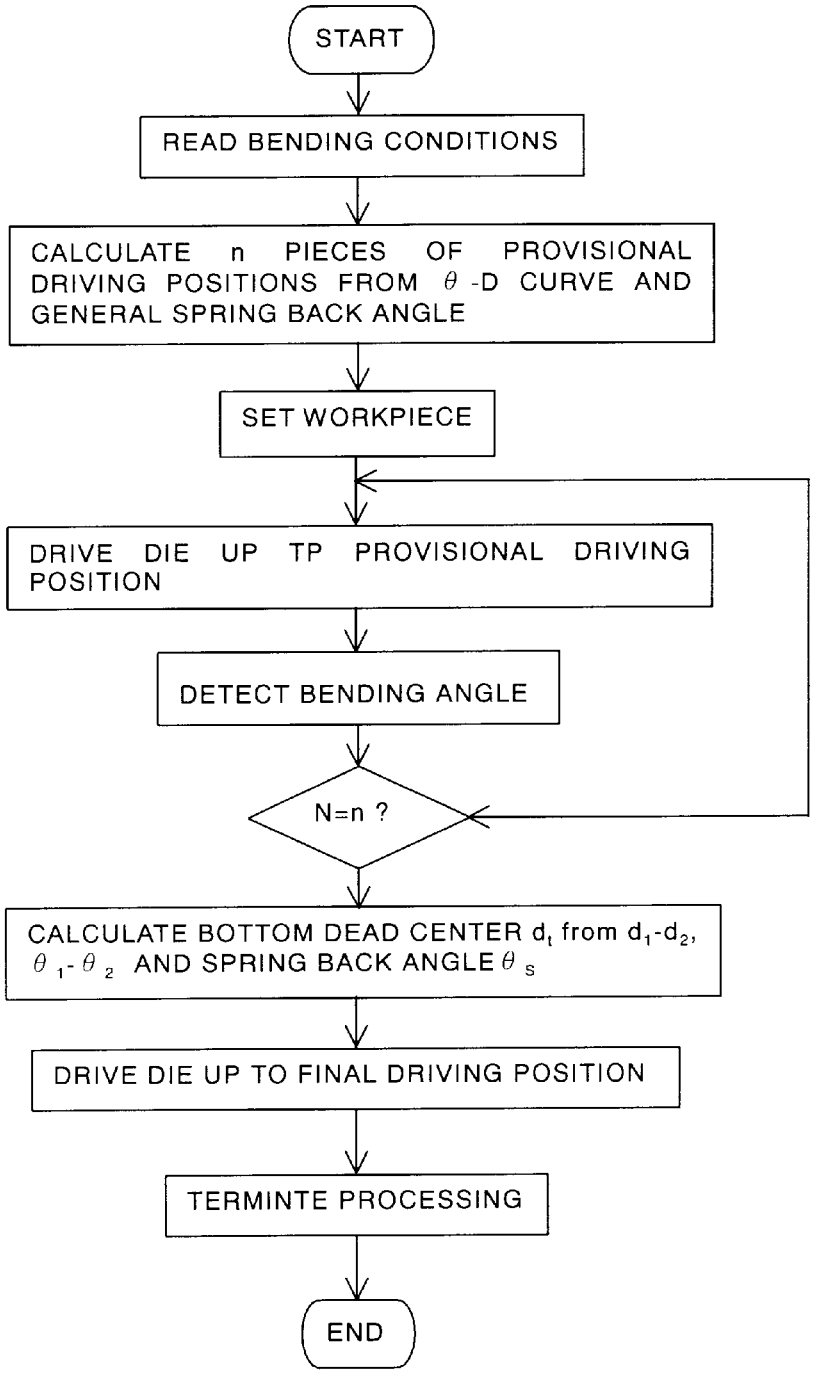
FIG. 8 is a flow chart showing the control flow of the die driving amount in the second embodiment.

In this embodiment, the drive control of the upper die 5 which is a driving die or, in other words, the control of die driving amount is performed as follows according to the flow chart indicated in FIG. 8.

T1: Reads the bending conditions (material, thickness, bending shape, die information, machine information, etc.) of the workpiece W input and stored in the storing means 12 in advance.

T2: Selects the relational expression of the default (initial value owned by the NC system) from the relationship of the die driving amount D to the bending angle θ of the workpiece D and the relationship of the spring back angle to the target bending angle of the workpiece, and calculates the provisional driving position at the time when the upper and lower dies are made to move closer to each other or, in other words, the angle detecting position at "n" points (n≧2). It is desired that those provisional driving positions be found in the range while not bending the workpiece W too much and that at least one point be at a position as close to the target angle as possible.

T3~T5: Starts bending as the workpiece W is set by the operator, and makes the upper die 5 move closer to the lower die 3 up to the first provisional driving position of the "n" points of provisional driving position. When (the upper die 5) reached this provisional driving position, detects the bending angle of the workpiece W with the angle detecting unit 7.

T6: Makes the upper die 5 move again to the second provisional driving position in the case where the number of times of angle detection N has not yet reached "n" (N<n), and detects the bending angle of the workpiece W again at this second provisional driving position. This processing is performed repeatedly until N=n is reached.

Figure 9:
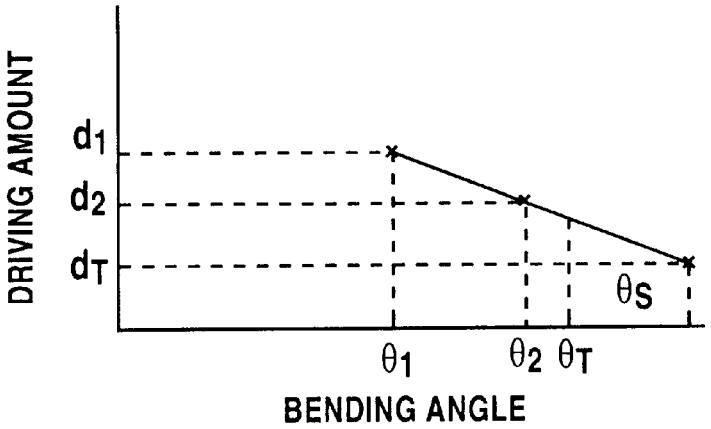
FIG. 9 is a graph explaining how to determine the final driving position $d_T$.

T7: Calculates the amount of change $d_1-d_2$ in the driving amount and the amount of change $\theta_1-\theta_2$ in the bending angle, from the results of detection of angle at "n" points (see FIG. 9). By using the relationship of the spring back angle θs to the target bending angle $\theta_T$ stored in advance, determines the final driving position (bottom dead center) $d_T$ where the target bending angle $\theta_T$ is obtained. Here, in the case where there are two (n=2) angle detecting positions (provisional driving positions) in the calculation of this final driving position $d_T$, the final driving position $d_T$ can be determined by determining a straight line passing through those two points based on two detected values, on a graph showing the relationship of the die driving amount D to the bending angle θ. Moreover, in the case where there are no less than three (n≧3) angle detecting positions (provisional driving positions), the final driving position $d_T$ can be determined by using the method of least squares, etc. based on no less than three detected values.

T8: Based on the estimated final driving position $d_T$, drives the upper die 5 again up to that position.

T9: Terminates the working to end the flow.

The processing indicated in this flow may be performed for each time of bending process, but corrective operation may also be instructed by the operator in any desired process at the time of change in material lot, etc.

Figure 10:
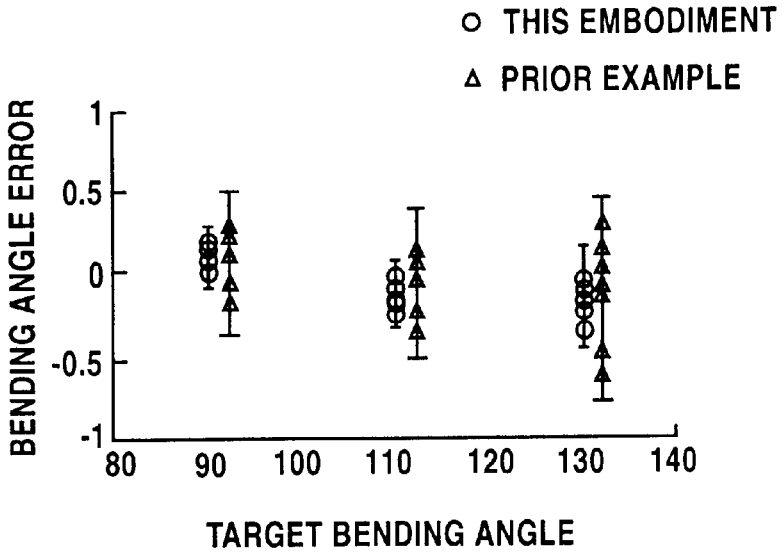
FIG. 10 is a drawing explaining the effects of the second embodiment.

FIG. 10 indicates the results of comparison between the bending apparatus according to this embodiment and a conventional bending apparatus (the one given in Japanese Patent Laid-Open Publication No. 7-265957 (1995)). From this drawing, it can be seen clearly that the apparatus according to this embodiment is capable of bending with higher accuracy. This is due to the fact that the final driving position is determined by taking account of the relationship of the driving amount to the bending angle, which is a substitute characteristic value of the mechanical properties of the material.

According to this embodiment, the final driving position of the driving die can be estimated based on the actual bending angle at no less than two angle detecting positions, and this makes it possible to estimate the final driving position with high accuracy even when there are some variations in the spring back angle due to variations from lot to lot in the material characteristic values, thus realizing bending with extremely high accuracy.

Embodiment 3

This embodiment is designed in such a way as to calculate the ratio dD/dθ of the amount of change dD in the respective driving amounts to the amount of change dθ in the respective bending angles at no less than two provisional driving positions, as substitute characteristic of the "n" value which is a characteristic value having the greatest influences on the spring back angle and, based on the relationship of the spring back angle θs to this ratio dD/dθ, calculate the spring back angle at the target bending angle. Moreover, it is also designed so as to calculate the final driving position (bottom dead center) where the target bending angle is obtained, based on the spring back angle at the target driving position determined as described earlier and the relationship of the amount of change dD in the respective provisional driving amounts to the amount of change in the respective actual bending angles dθ at no less than two provisional driving positions.

Figure 11:
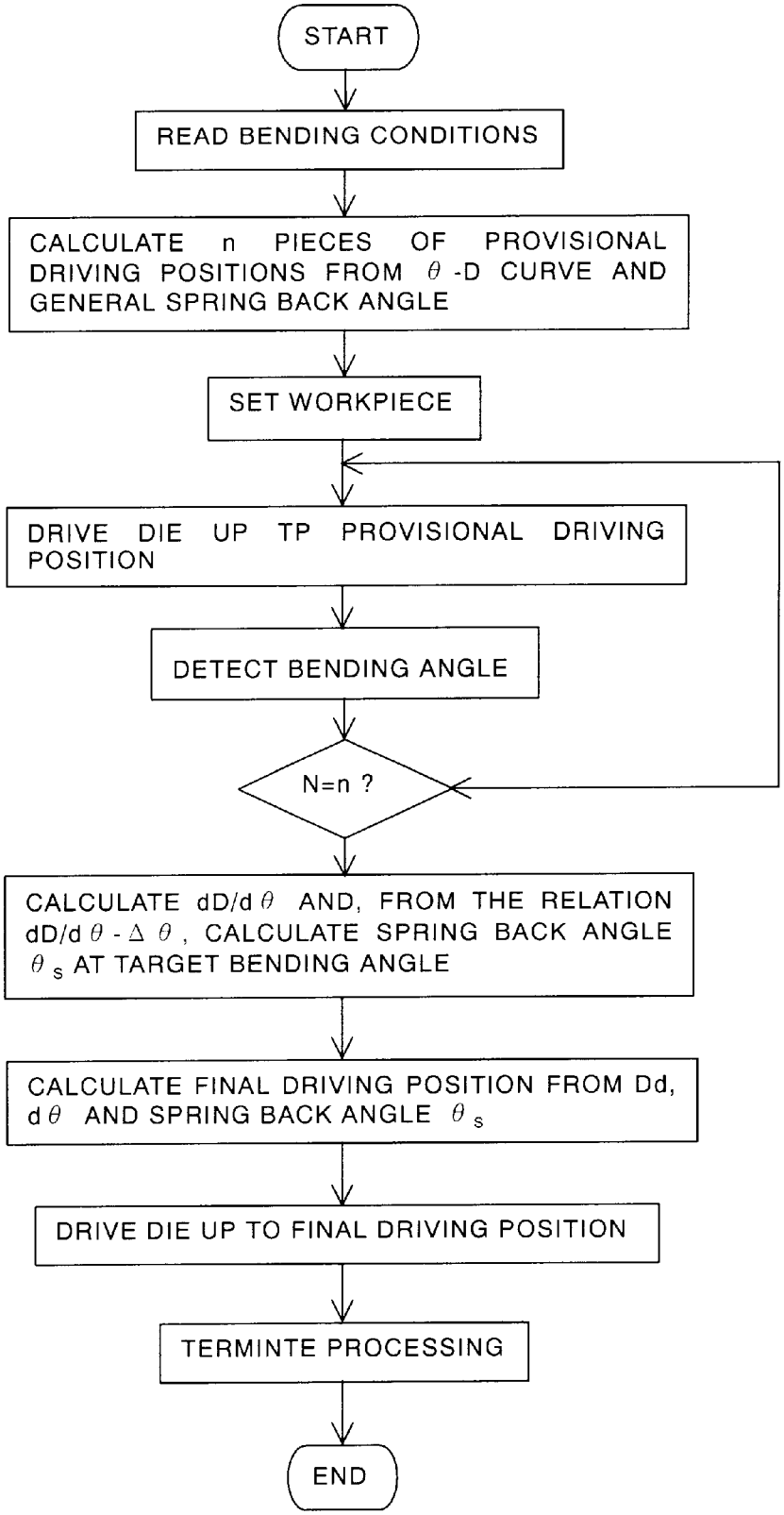
FIG. 11 is a flow chart showing the control flow of the die driving amount in the third embodiment.
Figure 12:
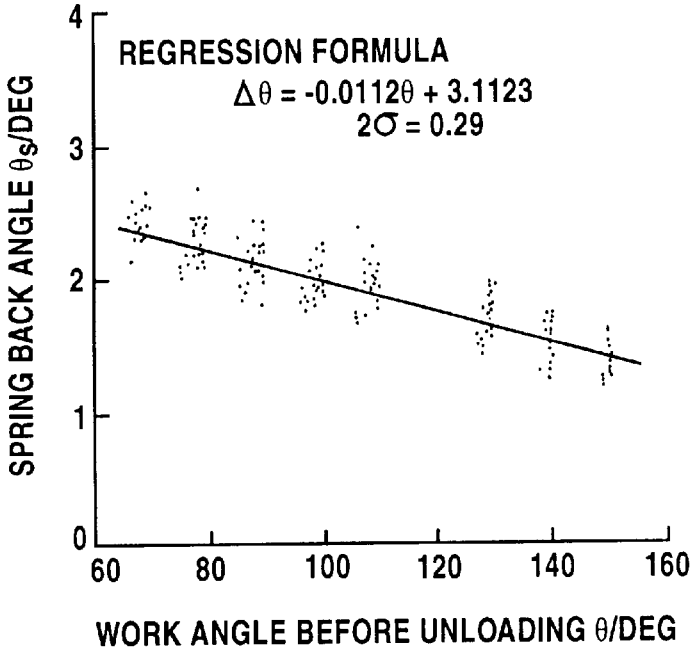
FIG. 12 is a graph showing the relationship of the workpiece angle to the spring back angle.
Figure 13:
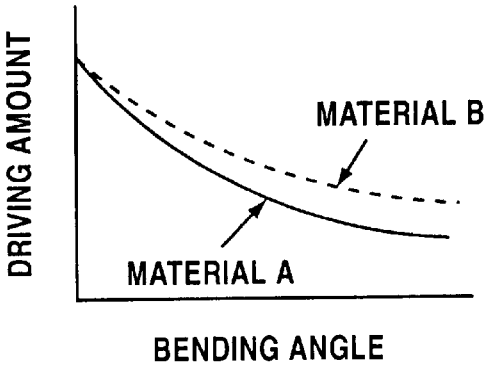
FIG. 13 is a graph explaining that the relationship of the driving amount to the bending angle varies depending on the material.

Next, the control flow of the die driving amount in this embodiment will be explained according to the flow chart indicated in FIG. 11.

U1: Reads the bending conditions (material, thickness, bending shape, die information, machine information, etc.) of the workpiece W input and stored in the storing means 12 in advance.

U2: Selects the relational expression of the default (initial value owned by the NC system) from the relationship of the die driving amount D to the bending angle θ (see FIG. 6) of the workpiece W and the relationship of the spring back angle to the target bending angle of the workpiece, and calculates the provisional driving position at the time when the upper and lower dies are made to move closer to each other or, in other words, the angle detecting position at "n" points (n≧2). It is desired that those provisional driving positions be found in the range while not bending the workpiece W too much and that at least one point be at a position as close to the target angle as possible.

U3~U5: Starts bending as the workpiece W is set by the operator, and makes the upper die 5 move closer to the lower die 3 up to the first provisional driving position of the "n" points of provisional driving position. When (the upper die 5) reached this provisional driving position, detects the bending angle of the workpiece W with the angle detecting unit 7.

U6: Makes the upper die 5 move again to the second provisional driving position in the case where the number of times N of angle detection has not yet reached "n" (N<n), and detects the bending angle of the workpiece W again at this second provisional driving position. This processing is performed repeatedly until N=n is reached.

U7: Calculates the ratio (dD/dθ) of the amount of change (dD) in the driving amount to the amount of change (dθ) in the bending angle, from the results of detection of angle at "n" points. In the case of n=2 for example, calculates the ratio dD/dθ of the difference dD in the driving amount and the difference dθ in the bending angle at two angle detecting positions. By using the relationship of the spring back angle θs to the ratio dD/dθ stored in advance or, in other words, the dD/dθ-θs curve (see FIG. 7), determines the spring back angle θs corresponding to dD/dθ-θs calculated as above. In this way, estimates the spring back angle θs at the target bending angle. Here, in the case where there are two (n=2) angle detecting positions (provisional driving positions) in the calculation of the ratio dD/dθ, the ratio dD/dθ can be determined by determining a straight line passing through those two points based on two detected values, on a graph showing the relationship of the die driving amount D to the bending angle θ. Moreover, in the case where there are no less than three (n≧3) angle detecting positions (provisional driving positions), the ratio dD/dθ can be determined by using the method of least squares, etc. based on (no less than) three detected values. FIG. 7 indicates the relationship of the spring back angle θs to the ratio dD/dθ.

U8: By using the relationship of the amount of change dD ($d_1-d_2$) in the driving amount obtained from the results of detection of angle at "n" points to the amount of change dθ ($\theta_1-\theta_2$) in the actual bending angle as well as the (relationship of the) spring back angle θs to the target bending angle $\theta_T$ determined as above, determines the final driving position $d_T$ where the target bending angle $\theta_T$ is obtained (see FIG. 9). Here, in the case where there are two (n=2) angle detecting positions (provisional driving positions) in the calculation of this final driving position $d_T$, the final driving position $d_T$ can be determined by determining a straight line passing through those two points based on two detected values, on a graph showing the relationship of the die driving amount D to the bending angle θ (see FIG. 9). Moreover, in the case where there are no less than three (n≧3) angle detecting positions (provisional driving positions), the final driving position $d_T$ can be determined by using the method of least squares, etc. based on no less than three detected values.

U9: Based on the estimated final driving position $d_T$, drives the upper die 5 again up to that position.

U10: Terminates the working to end the flow.

The processing indicated in this flow may be performed for each time of bending process, but corrective operation may also be instructed by the operator in any desired process at the time of change in material lot, etc. According to this embodiment, the spring back angle of the workpiece and the final driving position of the driving die can be estimated based on the actual bending angle at no less than two angle detecting positions, and this makes it possible to estimate the spring back angle and the final driving position with high accuracy even when there are some variations from lot to lot in the material characteristic values, and execute the bending based on this final driving position, thus enabling bending with extremely high accuracy.

In the respective embodiments, explanation was given on cases where an angle detecting device, consisting of a light source for projecting slit light and a CCD camera for photographing the linear projected image, is used as angle detecting means for detecting the bending angle, but other various types such as capacitance type, photoelectric type, contact type, etc. may also be adopted as this angle detecting means.

In the respective embodiments, explanation was given on cases where the invention is applied to a press brake of so-called overdrive type for driving the upper die (punch) with the lower die of fixed type, but the present invention can also be applied to press brake of so-called underdrive type for driving the lower die with the upper die of fixed type as a matter of course.

We claim:

1. A bending method for bending sheet-like workpiece by pressing it with a driving die and a fixed die, comprising the steps of:

detecting an actual bending angle of the workpiece at no less than two provisional driving positions of said driving die during bending of the workpiece, determining a relationship of a spring back angle to a target bending angle of the workpiece for the respective working conditions of the bending concerned which is stored in advance based on a relationship of an amount of change in a driving amount to an amount of change in the actual bending angle relating to each of the provisional driving positions, determining a final driving position of said driving die from the relationship of the spring back angle to the target bending angle, and driving of said die to the determined final driving position.

2. A bending method for bending sheet-like workpiece by pressing it with a driving die and a fixed die, comprising the steps of:

detecting an actual bending angle of the workpiece at no less than two provisional driving positions of said driving die during bending of the workpiece, determining a relationship of a spring back angle to a target bending angle of the workpiece for the respective working conditions of the bending concerned which is stored in advance based on a ratio of an amount of change in a driving amount to an amount of change in the actual bending angle relating to each of the provisional driving positions, determining said final driving position of said driving die by correcting the relationship of the spring back angle to the target bending angle based on a relationship of the spring back angle to said ratio of the amount of change in the driving amount to the amount of change in the actual bending angle, and driving said driving die to the determined final driving position.

3. A bending apparatus for bending sheet-like workpiece by pressing it with a driving die and a fixed die, comprising:

(a) storing means for storing a) a relationship of a driving amount of said driving die to a bending angle of the workpiece for the respective working conditions, and b) a relationship of a spring back angle to a ratio of an amount of change in the driving amount to an amount of change in an actual bending angle, (b) bending angle detecting means for detecting the bending angle during bending of the workpiece, (c) calculating means for calculating an amount of change in the actual bending angle of the workpiece detected by said bending angle detecting means at no less than two provisional driving positions of said driving angle and an amount of change in the driving amount relating to each of the respective driving positions, for calculating the spring back angle at the target bending angle of the workpiece from a relationship of the spring back angle to the ratio of amount of change in the driving amount to the amount of change in the actual bending angle stored in said storing means, and for calculating a final driving position of said driving die based on the calculated spring back angle, and (d) die driving means for driving said driving die to said final driving position after driving said driving die to each of said provisional driving positions.

4. A bending apparatus as defined in claim 3, wherein said calculating means calculates said final driving position of the driving die by correcting said relationship of the spring back angle to the target bending angle of the workpiece, based on the relationship of the spring back angle to said ratio of the amount of change in the driving amount to the amount of change in the actual bending angle.

5. A bending apparatus as defined in either claim 3 or claim 4, wherein said no less than two provisional driving positions are calculated from the relationship of the driving amount of the driving die to the bending angle of the workpiece and the relationship of the spring back angle to the bending angle of the workpiece stored in said storing means.

* * * * *